US009810070B2

(12) United States Patent
Johns et al.

(10) Patent No.: US 9,810,070 B2
(45) Date of Patent: Nov. 7, 2017

(54) TURBINE ROTOR BLADE FOR A TURBINE SECTION OF A GAS TURBINE

(71) Applicant: General Electric Company, Schenectady, NY (US)

(72) Inventors: David Richard Johns, Simpsonville, SC (US); Mark Andrew Jones, Greer, SC (US)

(73) Assignee: General Electric Company, Schenectady, NY (US)

( * ) Notice: Subject to any disclaimer, the term of this patent is extended or adjusted under 35 U.S.C. 154(b) by 1212 days.

(21) Appl. No.: 13/894,622

(22) Filed: May 15, 2013

(65) Prior Publication Data

US 2014/0338364 A1 Nov. 20, 2014

(51) Int. Cl.

| | |
|---|---|
| ***F01D 5/08*** | (2006.01) |
| ***F01D 5/18*** | (2006.01) |
| *F01D 5/30* | (2006.01) |

(52) U.S. Cl.

CPC ..... *F01D 5/084* (2013.01); *F01D 5/081* (2013.01); *F01D 5/187* (2013.01); *F01D 5/3007* (2013.01); *F05D 2240/81* (2013.01); *F05D 2260/201* (2013.01)

(58) Field of Classification Search

CPC ..... F01D 5/081; F01D 5/084; F01D 5/187; F01D 5/3007; F05D 2240/81; F05D 2260/201

See application file for complete search history.

(56) References Cited

U.S. PATENT DOCUMENTS

| | | | | |
|---|---|---|---|---|
| 5,730,584 | A | 3/1998 | Dodd | |
| 5,915,923 | A * | 6/1999 | Tomita | F01D 5/187 415/115 |
| 6,402,471 | B1 * | 6/2002 | Demers | F01D 5/081 415/115 |
| 6,431,833 | B2 | 8/2002 | Jones | |
| 6,478,540 | B2 | 11/2002 | Abuaf et al. | |
| 7,001,151 | B2 | 2/2006 | Wang et al. | |
| 7,131,817 | B2 * | 11/2006 | Keith | F01D 5/081 29/889.72 |
| 7,182,576 | B2 | 2/2007 | Bunker et al. | |
| 7,281,894 | B2 | 10/2007 | Lee et al. | |
| 7,322,797 | B2 | 1/2008 | Lee et al. | |
| 7,438,532 | B2 | 10/2008 | Zemitis | |
| 7,467,922 | B2 * | 12/2008 | Beeck | F01D 5/147 415/115 |
| 8,210,821 | B2 | 7/2012 | Arness et al. | |
| 2006/0056968 | A1 | 3/2006 | Jacala et al. | |

(Continued)

*Primary Examiner* — Igor Kershteyn
(74) *Attorney, Agent, or Firm* — Dority & Manning, P.A.

(57) ABSTRACT

A turbine rotor blade includes a mounting portion that partially defines a cooling circuit within the turbine rotor blade and an airfoil portion that extends radially outward from the mounting portion. The airfoil portion further defines the cooling circuit. The turbine rotor blade further includes a platform portion that is disposed radially between the mounting portion and the airfoil. The platform portion includes a bottom wall, a top wall, a forward wall, an aft wall and a pair of opposing side walls. A cooling plenum that at least partially defines the cooling circuit is defined within the platform portion. The cooling plenum is at least partially defined between the forward wall, the aft wall and between the pair of opposing side walls.

18 Claims, 10 Drawing Sheets

(56) References Cited

U.S. PATENT DOCUMENTS

| | | | | |
|---|---|---|---|---|
| 2006/0269409 | A1* | 11/2006 | Torii | F01D 5/187<br>416/97 R |
| 2012/0082548 | A1* | 4/2012 | Ellis | F01D 5/087<br>416/95 |
| 2012/0082550 | A1* | 4/2012 | Harris, Jr. | F01D 5/081<br>416/95 |
| 2013/0028708 | A1 | 1/2013 | Jayana | |
| 2013/0115102 | A1* | 5/2013 | Walunj | F01D 5/186<br>416/97 R |

* cited by examiner

TURBINE ROTOR BLADE FOR A TURBINE SECTION OF A GAS TURBINE

FIELD OF THE INVENTION

The present invention generally relates to a turbine rotor blade for a turbine section of a gas turbine. More particularly, this invention involves cooling the turbine rotor blade.

BACKGROUND OF THE INVENTION

A typical gas turbine includes an inlet section, a compressor section, a combustion section, a turbine section, and an exhaust section. The inlet section cleans and conditions a working fluid (e.g., air) and supplies the working fluid to the compressor section. The compressor section progressively increases the pressure of the working fluid and supplies a compressed working fluid to the combustion section. The compressed working fluid is mixed with a fuel such as natural gas to provide a combustible mixture.

The combustible mixture is injected into a combustion zone defined within a combustion chamber where it is burned to generate combustion gases having a high temperature and pressure. The combustion gases are routed through a hot gas path that is defined within the combustor into the turbine section. Thermal and kinetic energy is transferred from the combustion gases to successive stages of turbine rotor blades that are coupled to a rotor wheel or disk that is coupled to a shaft, thereby causing the shaft to rotate and produce work. For example, the shaft may drive a generator to produce electricity.

Turbine rotor blades typically include an airfoil portion, a mounting or root portion and a hollow base or shank portion that extends radially between the root portion and the airfoil portion. The mounting portion generally includes a dovetail feature for securing the turbine rotor blade to the rotor disk. A generally rectangular platform portion is disposed between the shank and the airfoil. The platform generally includes a bottom or cold side and a top or hot side where the hot side is directly exposed to the hot combustion gases. The airfoil extends generally radially outward from the hot side of the platform.

High combustion gas temperatures within the turbine section generally corresponds to greater thermal and kinetic energy transfer between the combustion gases and the turbine rotor blades, thereby enhancing overall power output of the gas turbine. However, the high combustion gas temperatures may lead to erosion, creep, and/or low cycle fatigue to the turbine rotor blades, thereby limiting durability of the turbine rotor blades. Therefore, continued improvements in turbine rotor blade cooling schemes and methods for cooling the turbine rotor blade would be useful.

BRIEF DESCRIPTION OF THE INVENTION

Aspects and advantages of the invention are set forth below in the following description, or may be obvious from the description, or may be learned through practice of the invention.

One embodiment of the present invention is a turbine rotor blade. The turbine rotor blade includes a mounting portion that partially defines a cooling circuit within the turbine rotor blade, an airfoil portion that extends radially outward from the mounting portion and further defines the cooling circuit and a platform portion that is disposed radially between the mounting portion and the airfoil portion. The platform portion includes a bottom wall, a top wall, a forward wall, an aft wall and a pair of opposing side walls. The turbine rotor blade further includes a cooling plenum that is defined within the platform portion. The cooling plenum further defines the cooling circuit. The cooling plenum is at least partially defined between the forward wall, the aft wall and between the pair of opposing side walls within the platform portion.

Another embodiment of the present invention is a turbine section of a gas turbine. The turbine section includes a rotor shaft and a rotor disk coupled to the rotor shaft. The rotor disk includes a slot and defines a cooling flow outlet that extends through the slot. The turbine section further includes a turbine rotor blade that extends radially outward from the rotor disk. The turbine rotor blade comprises a mounting portion disposed within the slot, an airfoil portion that extends radially outward from the mounting portion, a cooling circuit that extends between the mounting portion and the airfoil portion. The cooling circuit is in fluid communication with the cooling flow outlet. The turbine rotor blade further includes a platform portion that is disposed radially between the mounting portion and the airfoil portion. The platform portion includes a bottom wall, a top wall, a forward wall, an aft wall and a pair of opposing side walls. The turbine rotor blade further includes a cooling plenum that is defined within the platform portion. The cooling plenum further defines the cooling circuit. The cooling plenum is at least partially defined between the forward wall, the aft wall and between the pair of opposing side walls within the platform portion.

Another embodiment of the present invention is a gas turbine. The gas turbine includes a compressor section, a combustion section disposed downstream from the combustion section, and a turbine section disposed downstream from the combustion section. The turbine section includes a rotor shaft, a rotor disk coupled to the rotor shaft where the rotor disk defines a plurality of slots having a cooling flow outlet. A plurality of turbine rotor blades extends radially outward from the rotor disk. Each turbine rotor blade comprises a mounting portion disposed within a corresponding slot, an airfoil portion that extends radially outward from the mounting portion, a cooling circuit that extends between the mounting portion and the airfoil portion where the cooling circuit is in fluid communication with the cooling flow outlet and a platform portion that is disposed radially between the mounting portion and the airfoil portion. The platform portion includes a bottom wall, a top wall, a forward wall, an aft wall and a pair of opposing side walls. The turbine rotor blade further includes a cooling plenum that is defined within the platform portion. The cooling plenum further defines the cooling circuit. The cooling plenum is at least partially defined between the forward wall, the aft wall and between the pair of opposing side walls within the platform portion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
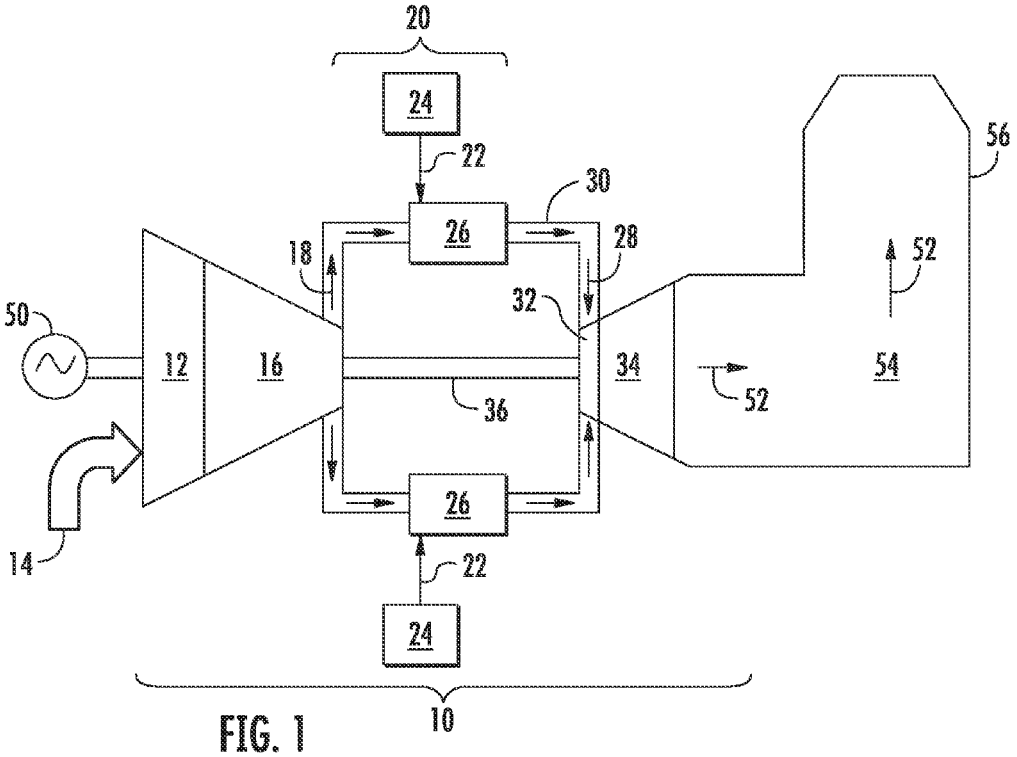
FIG. 1 (PRIOR ART)
FIG. 1 illustrates a functional block diagram of an exemplary gas turbine as may incorporate at least one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the drawings, wherein identical numerals indicate the same elements throughout the figures. FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic and thermal energy to the working fluid 14 to produce a compressed working fluid 18. The compressed working fluid 18 flows from the compressor to a combustion section 20 where it is mixed with a fuel 22 from a fuel supply system 24 to form a combustible mixture within one or more combustors 26. The combustible mixture is burned to produce combustion gases 28 at high temperature and pressure. The combustion gases 28 are routed through a hot gas path 30 towards an inlet 32 of a turbine section 34.

Figure 2:
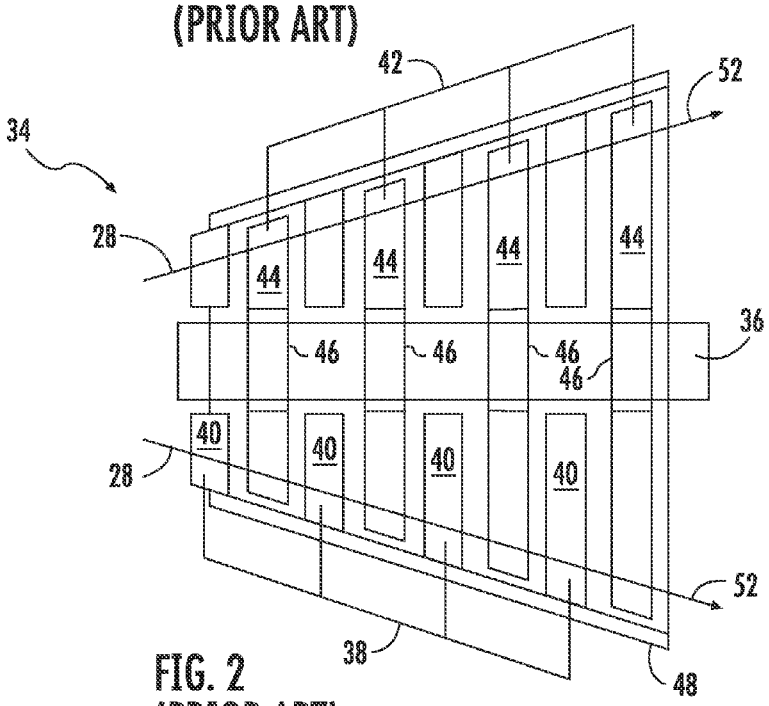
FIG. 2 (PRIOR ART)
FIG. 2 illustrates a cross section side view of an exemplary turbine section as may encompass various embodiments of the present invention.

FIG. 2 provides a cross section side view of an exemplary turbine section 34 as may encompass various embodiments of the present invention. As shown, the turbine section 34 generally includes one or more stages 38 of turbine nozzle segments 40 that are arranged in an annular array around a rotor shaft 36. One or more stages 42 of turbine rotor blades 44 are arranged in an annular array around and are coupled to the rotor shaft 36 via a rotor wheel or disk 46. The turbine nozzle segments 40 are fixed in position and remain stationary during operation of the gas turbine 10. The turbine rotor blades 44 rotate with the rotor shaft 36 during operation of the gas turbine 10. Each stage 38 of the turbine nozzle segments 40 is disposed upstream from a stage 42 of the turbine rotor blades 44. An outer casing 48 circumferentially surrounds the various stages 38 of turbine nozzle segments 40 and the various stages 42 of the turbine rotor blades 44.

As shown in FIG. 2, the combustion gases 28 flow across a stage 38 of the turbine nozzle segments 40 and are directed towards a stage 42 of the turbine rotor blades 44. As the combustion gases 28 flow through the turbine section 34, thermal and kinetic energy are transferred to the turbine rotor blades 44 at each stage 42, thereby causing the rotor shaft 36 to rotate and produce work. For example, as shown in FIG. 1, the rotor shaft 36 may be connected to the compressor 16 to produce the compressed working fluid 18. Alternately or in addition, the rotor shaft 36 may connect the turbine section 34 to a generator 50 for producing electricity. As shown in FIG. 1, exhaust gases 52 from the turbine section 34 flow through an exhaust section 54 that connects the turbine section 34 to an exhaust stack 56. The exhaust section 54 may include, for example, a heat recovery steam generator (not shown) for cleaning and extracting additional heat from the exhaust gases 52 prior to release to the environment.

Figure 3:
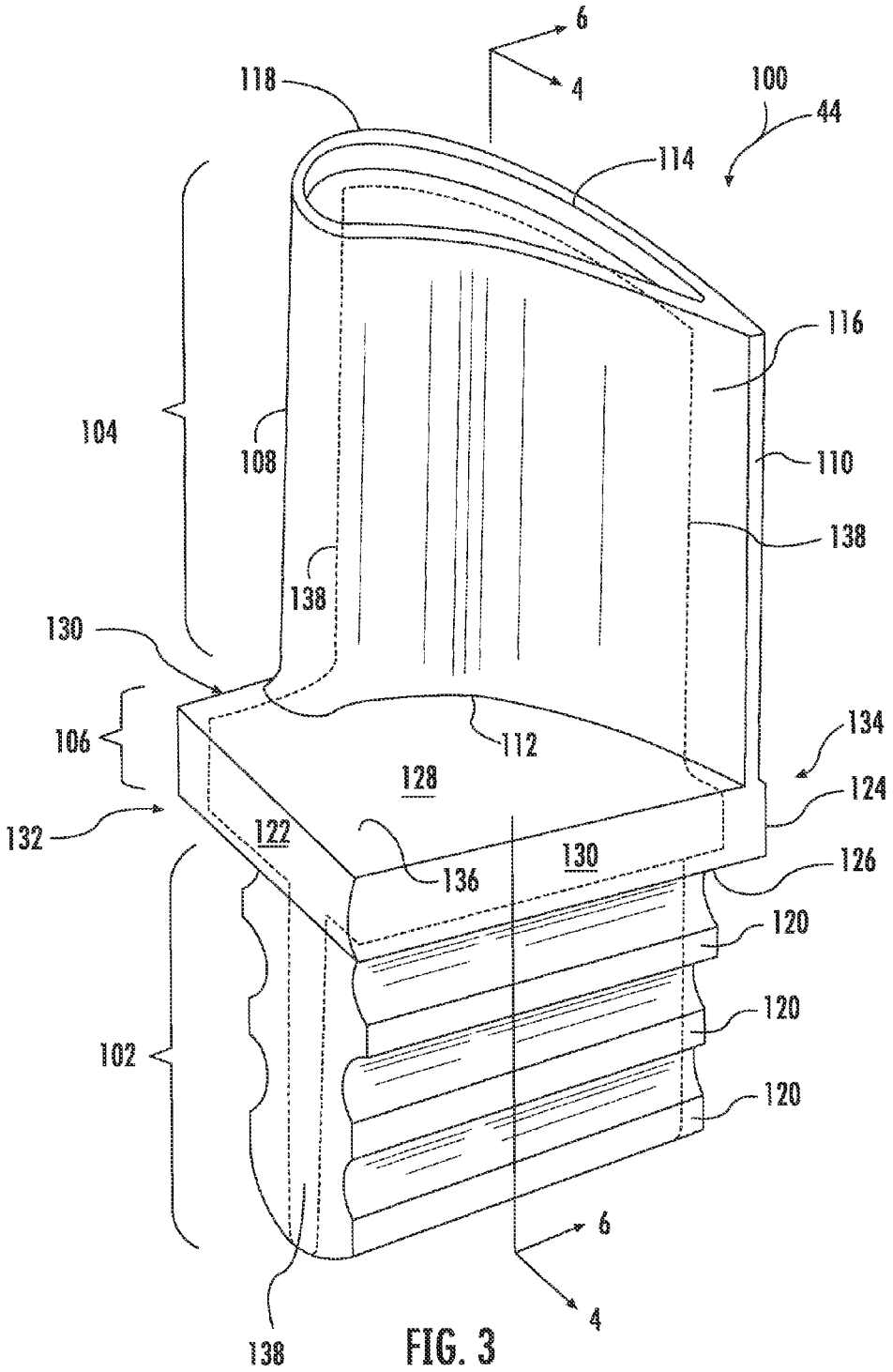
FIG. 3 illustrates a perspective view of an exemplary turbine rotor blade according to one embodiment of the present invention.

FIG. 3 provides a perspective view of an exemplary turbine rotor blade 100 as may incorporate various embodiments of the present disclosure and that is intended to replace the turbine rotor blade 44 shown in FIG. 2. As shown in FIG. 3, the turbine rotor blade 100 generally comprises a mounting portion 102, an airfoil portion 104 that extends radially outward from the mounting portion 102 and a platform portion 106 that extends radially between the mounting portion and the airfoil portion 104. In particular embodiments, the platform portion 106 is adjacent to the mounting portion 102, thereby eliminating an additional hollowed out shank or extension portion (not shown) of the turbine rotor blade 100 that typically extends between the mounting portion 102 and the platform portion 106.

The airfoil portion 104 generally includes a leading edge 108, a trailing edge 110, a root portion 112, a tip portion 114, a pressure side 116 and a suction side 118. The mounting portion 102 generally includes one or more coupling features 120 to couple to the turbine rotor blade 100 to the rotor disk 46 (FIG. 2). The coupling features 120 may be dovetail shaped, fir-tree shaped or have any shape that is sufficient to secure the turbine rotor blade 100 to the rotor disk 46 (FIG. 2).

In particular embodiments, as shown in FIG. 3, the platform portion 106 includes a forward wall 122, an aft wall 124, a bottom wall 126, a top wall 128 and a pair of opposing side walls 130. The forward wall 122, aft wall 124, and the pair of opposing side walls 130 extend continuously between the bottom wall 126 and the top wall 128. The forward wall 122 at least partially defines a leading portion 132 of the platform portion 106 and the aft wall 124 at least partially defines a trailing portion 134 of the platform portion 106. The airfoil portion 104 extends generally radially outward from a hot gas side 136 of the top wall 128. In various embodiments, a cooling circuit 138 extends within at least a portion of the turbine rotor blade 100. In one embodiment, the cooling circuit 138 is at least partially defined by the mounting portion 102, the platform portion 106 and the airfoil portion 104.

Figure 4:
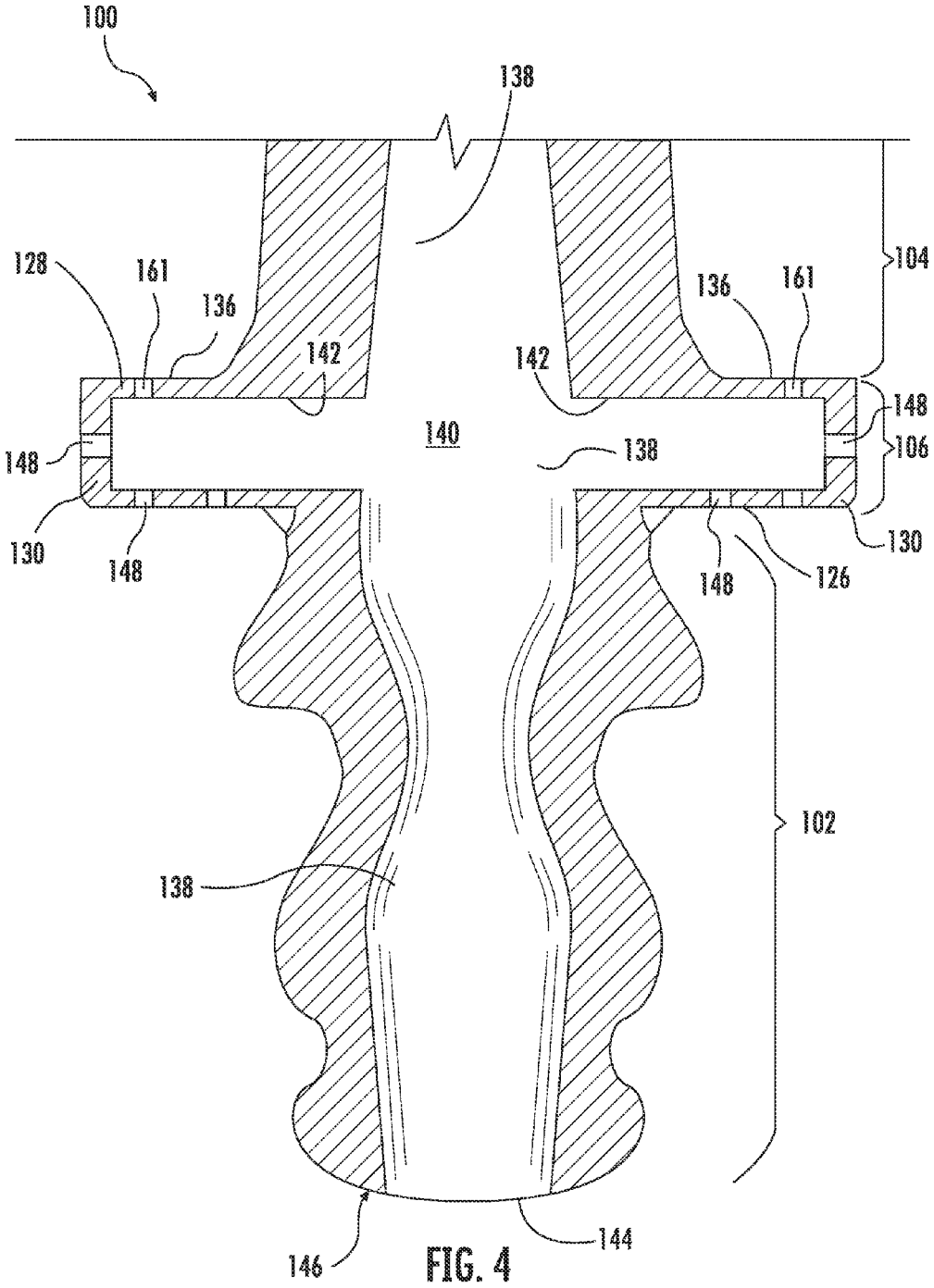
FIG. 4 provides a cross section front view of the turbine rotor blade as shown in FIG. 3, according to one embodiment of the present invention.

FIG. 4 provides a cross section front view of a portion of the turbine rotor blade 100 as shown in FIG. 3, according to one embodiment of the present invention. As shown in FIG. 4, a cooling plenum 140 is defined within the platform portion 106. The cooling plenum 140 is in fluid communication with the cooling circuit 138. In one embodiment, the cooling plenum 140 at least partially defines the cooling circuit 138, thereby providing for fluid communication between the mounting portion 102 and the airfoil portion 104 of the turbine rotor blade 100. In particular embodiments, the cooling plenum 140 is at least partially defined by the forward wall 122 (FIG. 3), the aft wall 124 (FIG. 3), the bottom wall 126 (FIGS. 3 and 4), the top wall 128 (FIGS. 3 and 4) and the pair of opposing side walls 130 (FIGS. 3 and 4). As shown in FIG. 4, the top wall 128 further includes a cold or inner side 142 disposed within the cooling plenum 140. The inner side 142 is radially separated from and in thermal communication with the hot gas side 136.

A cooling medium inlet 144 provides for fluid communication into the cooling circuit 138. In one embodiment, the cooling medium inlet 144 extends through a bottom side 146 of the mounting portion 102. The turbine rotor blade 100 may include a plurality of cooling medium inlets 144 that provide for fluid communication into the cooling circuit 138. In one embodiment, one or more cooling flow exhaust ports 148 provide for fluid communication out of the cooling plenum 140. In one embodiment, at least one of the cooling flow exhaust ports 148 extends through at least one side wall 130 of the pair of opposing side walls 130. In addition or in the alternative, at least one of the cooling flow exhaust ports 148 may extend through the bottom wall 126.

Figure 5:
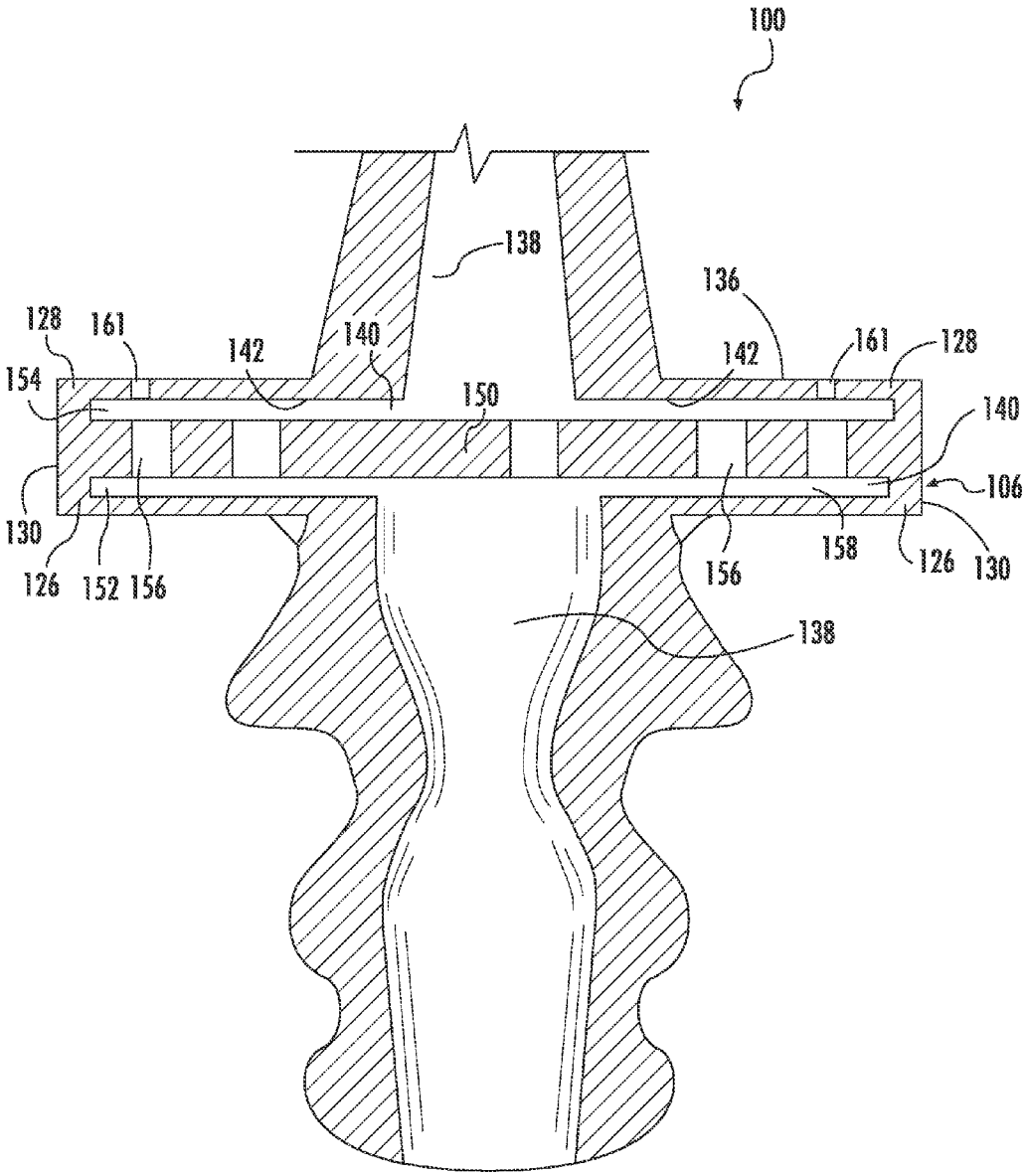
FIG. 5 provides a cross section front view of the turbine rotor blade as shown in FIG. 3, according to one embodiment of the present invention.
Figure 6:
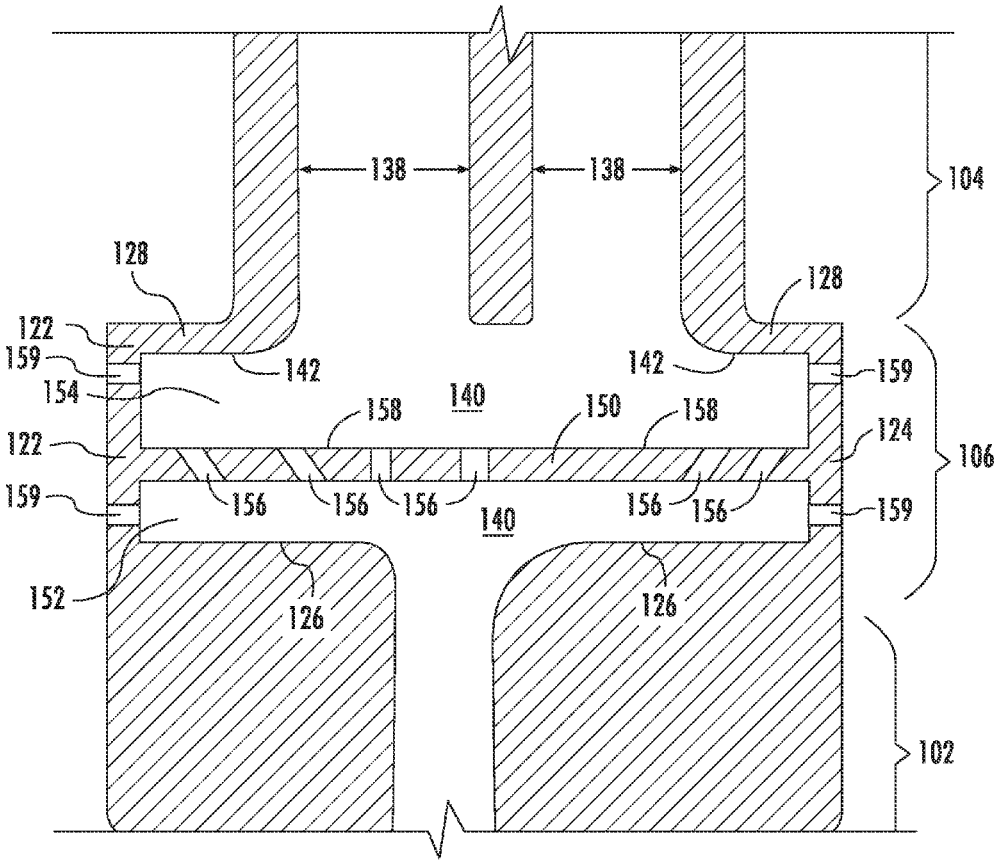
FIG. 6 provides a cross section side view of the turbine rotor blade as shown in FIG. 5, according to one embodiment of the present invention.

FIG. 5 provides a cross section front view of a portion of the turbine rotor blade 100 as shown in FIG. 4, according to at least one embodiment of the present invention. FIG. 6 provides a cross section side view of the turbine rotor blade 100 as shown in FIG. 5. In particular embodiments, as shown in FIGS. 5 and 6, an impingement plate 150 is disposed within the cooling plenum 140. The impingement plate 150 generally extends substantially parallel to the inner surface 142 of the top wall 128. The impingement plate 150 is radially separated from the bottom wall 126 to form a first cooling chamber 152 therebetween within the cooling plenum 140. The impingement plate 150 is radially separated from the inner side 142 of the top wall 128 so as to define a second cooling chamber 154 therebetween within the cooling plenum 140. In particular embodiments, the impingement plate 150 extends at least partially between the forward wall 122 (FIG. 6), the aft wall 124 (FIG. 6) and the pair of opposing side walls 130 (FIG. 5).

In particular embodiments, as shown in FIGS. 5 and 6, a plurality of impingement cooling holes 156 extend through the impingement plate 150. The impingement cooling holes 156 may have any cross-sectional shape such as circular or conical. The impingement cooling holes 156 provide for fluid communication between the first cooling chamber 152 and the second cooling chamber 154. The impingement cooling holes 156 at least partially define the cooling circuit 138.

As shown in FIG. 6, the impingement cooling holes 156 may be angled or tilted with respect to a top surface 158 of the impingement plate 150. As shown in FIG. 6, one or more purge openings 159 may extend through the forward wall 122 or the aft wall 124 to provide for fluid communication out of the cooling plenum 140. In particular embodiments, the purge openings 148 may be positioned radially above the impingement plate 150 and/or radially below the impingement plate 150.

In particular embodiments, as shown in FIGS. 4 and 5, the turbine rotor blade 100 may further include one or more film cooling openings 161 that extend through the top wall 128. The film cooling openings 161 provide for fluid communication from the cooling plenum 140 and/or the first cooling chamber 154 through the top wall 128 to provide film cooling to the hot gas side 136 of the turbine rotor blade 100.

Figure 7:
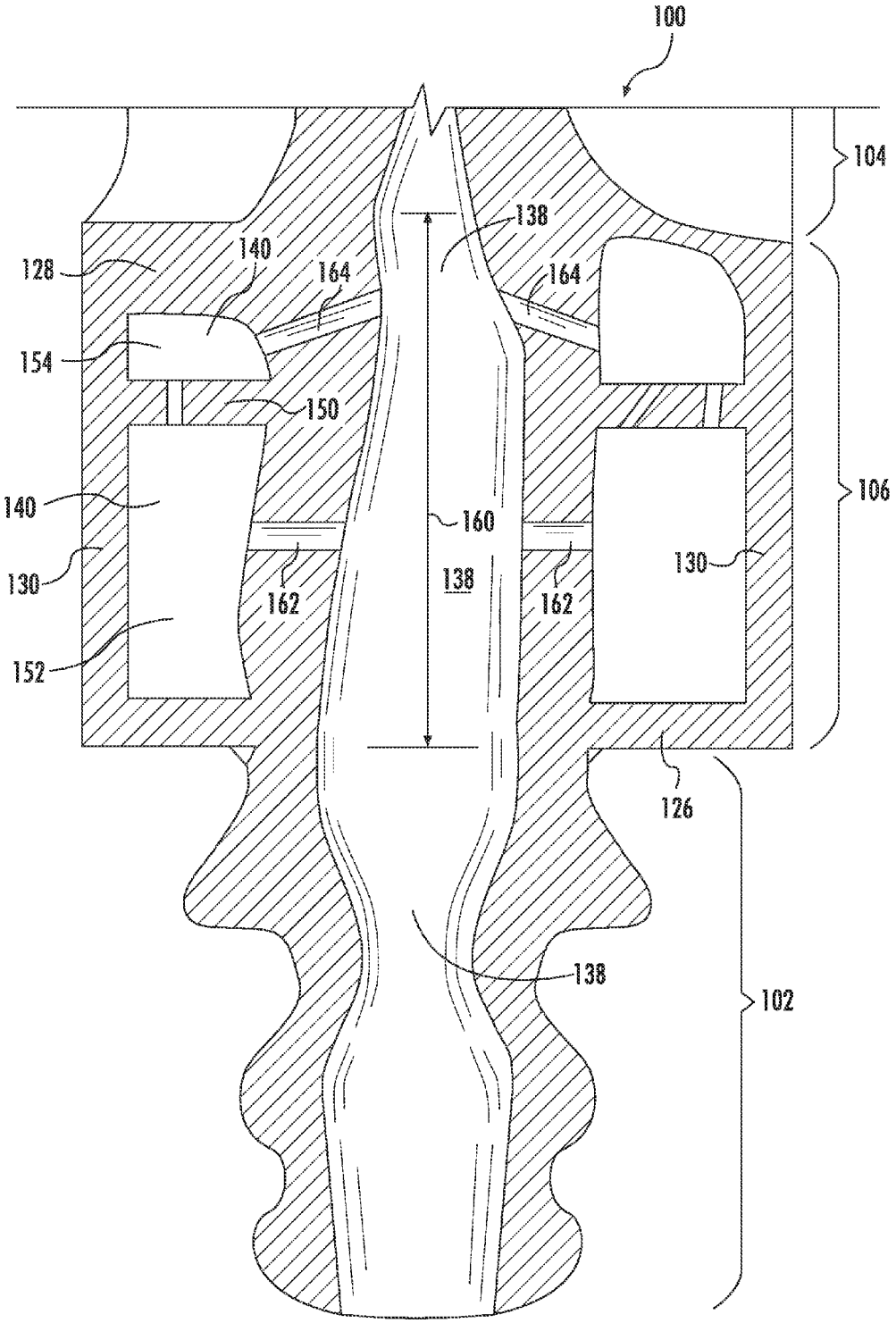
FIG. 7 provides a cross section front view of the turbine rotor blade as shown in FIG. 3, according to one embodiment of the present invention.

FIG. 7 provides a cross section front view of the turbine rotor blade 100 as shown in FIG. 3, according to at least one embodiment. As shown in FIG. 7, the turbine rotor blade 100 may further include a shank portion 160 that extends at least partially between the mounting portion 102 and the airfoil portion 104. The shank portion 160 extends through the cooling plenum 140 and is at least partially encased between the forward wall 122 (FIG. 3), the aft wall 124 (FIG. 3), the bottom wall 126 (FIG. 7), the top wall 128 (FIG. 7) and the pair of opposing side walls 130 (FIG. 7). As shown in FIG. 7, the shank portion 160 at least partially defines the cooling circuit 138 within the turbine rotor blade 100. In one embodiment, the impingement plate 150 is disposed within the cooling plenum 140.

One or more inlet passages 162 may extend through the shank portion 160 to provide for fluid communication into the cooling plenum 140. In particular embodiments, the one or more inlet passages 162 provide for fluid communication between the cooling circuit 138 and the first cooling chamber 152. One or more outlet passages 164 may extend through the shank portion 160 downstream from the inlet passages 162 to provide for fluid communication between the cooling plenum 140 and the cooling circuit 138. In particular embodiments, the outlet passages 164 provide for fluid communication between the second cooling chamber 154 and the cooling circuit 138.

Figure 8:
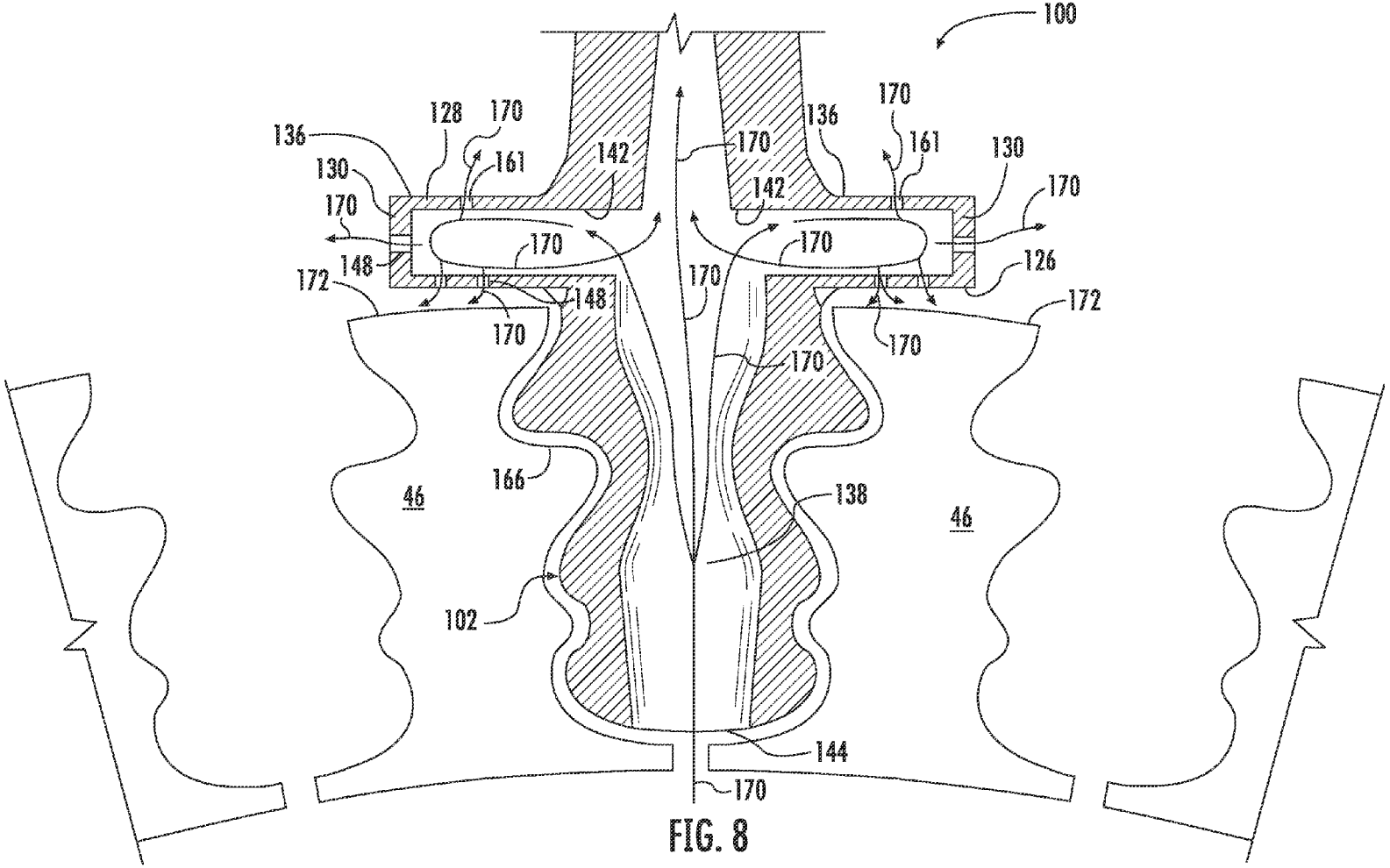
FIG. 8 provides a cross section front view of the turbine rotor blade as shown in FIG. 4 and a portion of a rotor disk, according to one embodiment of the present invention.

FIG. 8 provides a cross section front view of a portion of the turbine rotor blade 100 as shown in FIG. 4 coupled into a slot 166 of the rotor disk 46 according to at least one embodiment of the present invention. As shown in FIG. 8, the mounting portion 102 of the turbine rotor blade 100 is disposed within the slot 166 and the remaining portions of the turbine rotor blade 100 extend radially outward from the rotor disk 46. A cooling flow outlet 168 extends through the rotor disk 46 to provide for fluid communication between a cooling medium source (not shown) such as the compressor (FIG. 1) and the cooling medium inlet 144 of the turbine rotor blade 100.

In operation, as shown in FIG. 8, a cooling medium 170 such as compressed air is directed from the cooling flow outlet 168 through the cooling medium inlet 144 and into the cooling circuit 138. The cooling medium 170 is routed through the cooling circuit within the mounting portion 102 to provide conductive and/or convective cooling to the mounting portion 102. In one embodiment, as shown in FIG. 8, the cooling medium 170 is then routed directly onto or impinged onto the inner surface 142 of the top wall 128, thereby providing at least one of impingement, convective or conductive cooling to the top wall 128, in particular removing heat from the hot gas side 136 of the top wall 128. A portion of the cooling medium 170 may be routed through one or more of the one or more exhaust ports 148. In one embodiment, a portion of the cooling medium 170 is routed through the bottom wall 126 to provide impingement and/or convective cooling to an outer surface 172 of the rotor disk 46. In addition or in the alternative, a portion of the cooling medium 170 may be routed through one or more of the exhaust ports 148 that extend through one or both of the opposing side walls 130 to provide cooling between an adjacent platform portion (not shown) of adjacent turbine rotor blades (not shown). In addition or in the alternative, a portion of the cooling medium 170 may be routed through the film cooling openings 161 to provide film cooling to the hot gas side 136 of the top wall 128.

Figure 9:
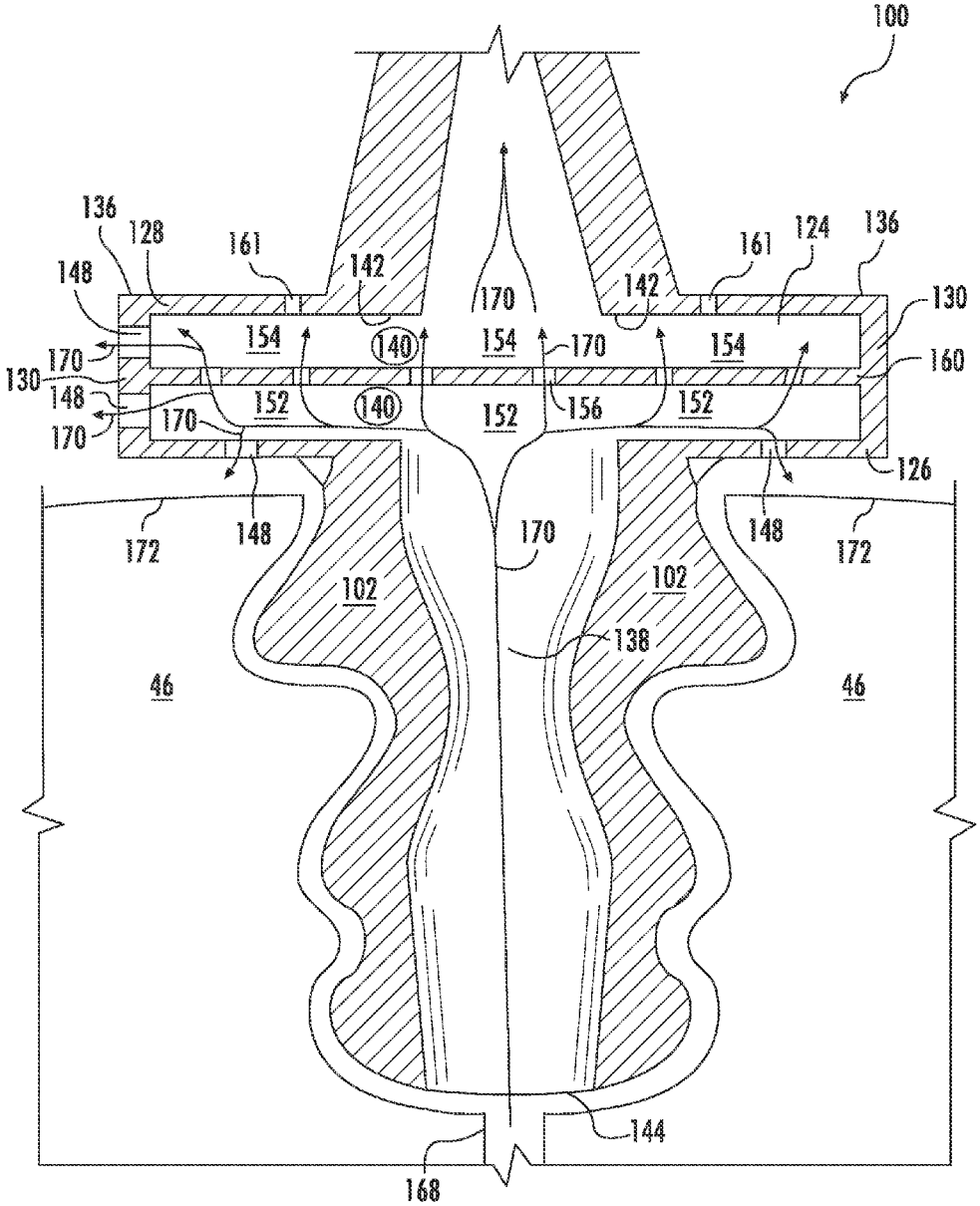
FIG. 9 provides a cross section front view of the turbine rotor blade as shown in FIG. 5 and a portion of a rotor disk, according to one embodiment of the present invention.

FIG. 9 provides a cross section of the turbine rotor blade 100 as shown in FIG. 5 and a portion of the rotor disk 46 according to another embodiment of the present invention. As shown in FIG. 9, the cooling medium 170 may flow through the portion of the cooling circuit 138 defined within the mounting portion 102 and into the first cooling chamber 152 of the cooling plenum 140. At least a portion of the cooling medium 170 is routed through the impingement cooling holes 156 and into the second cooling chamber 154.

The impingement cooling holes 156 are configured to focus a jet of the cooling medium 170 onto at least one of the inner side 142 of the top wall 128, one or both of the pair of opposing side walls 130, the forward wall 122 (FIG. 6) or the aft wall 124 (FIG. 6) so as to provide at least one of impingement, convective or conductive cooling to any or all of those walls or surfaces. A portion of the cooling medium 170 may be routed through one or more of the one or more exhaust ports 148. In one embodiment, a portion of the cooling medium 170 is routed through the one or more exhaust ports 148 in the bottom wall 126 to provide impingement and/or convective cooling to the outer surface 172 of the rotor disk 46. In addition or in the alternative, a portion of the cooling medium 170 may be routed through one or more of the exhaust ports 148 that extend through one or both of the opposing side walls 130 to provide cooling between adjacent platform portions of adjacent turbine rotor blades (not shown). In addition or in the alternative, a portion of the cooling medium 170 may be routed through the film cooling openings 161 to provide film cooling to the hot gas side 136 of the top wall 128.

Figure 10:
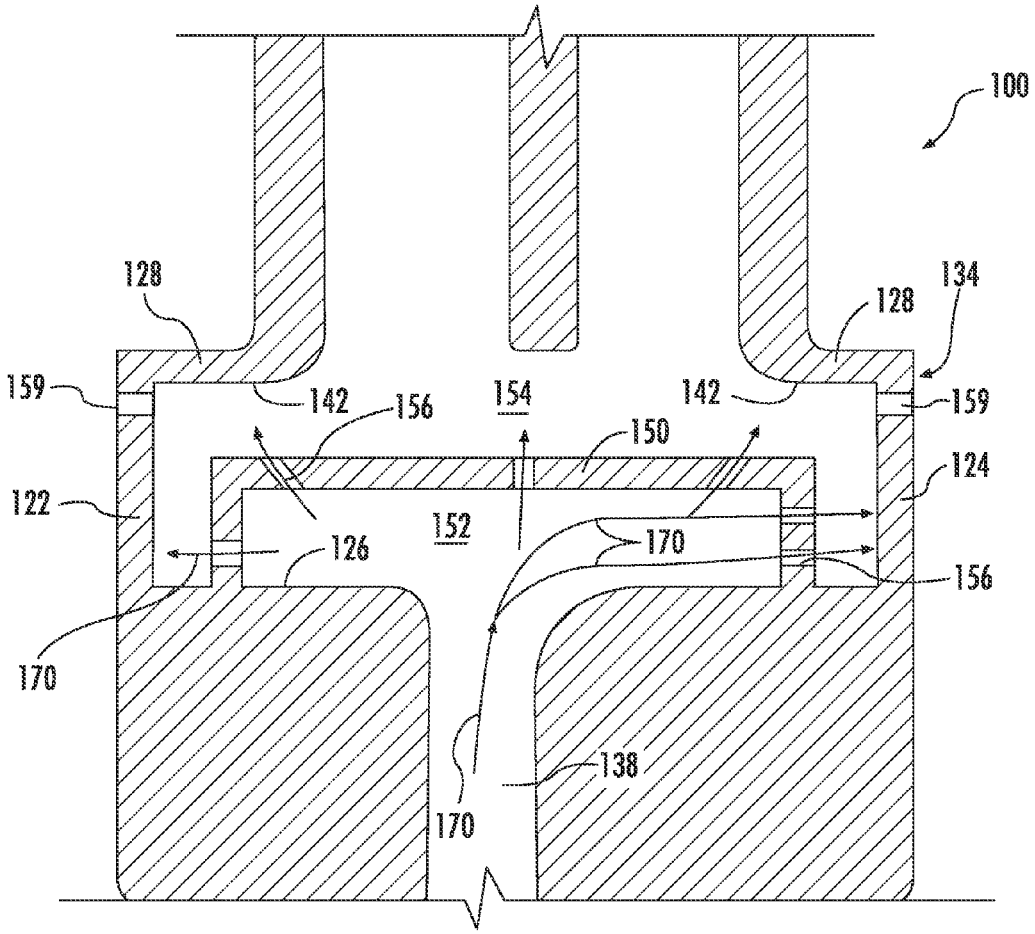
FIG. 10 provides a cross section side view of the turbine rotor blade as shown in FIG. 6, according to one embodiment of the present invention.
Figure 11:
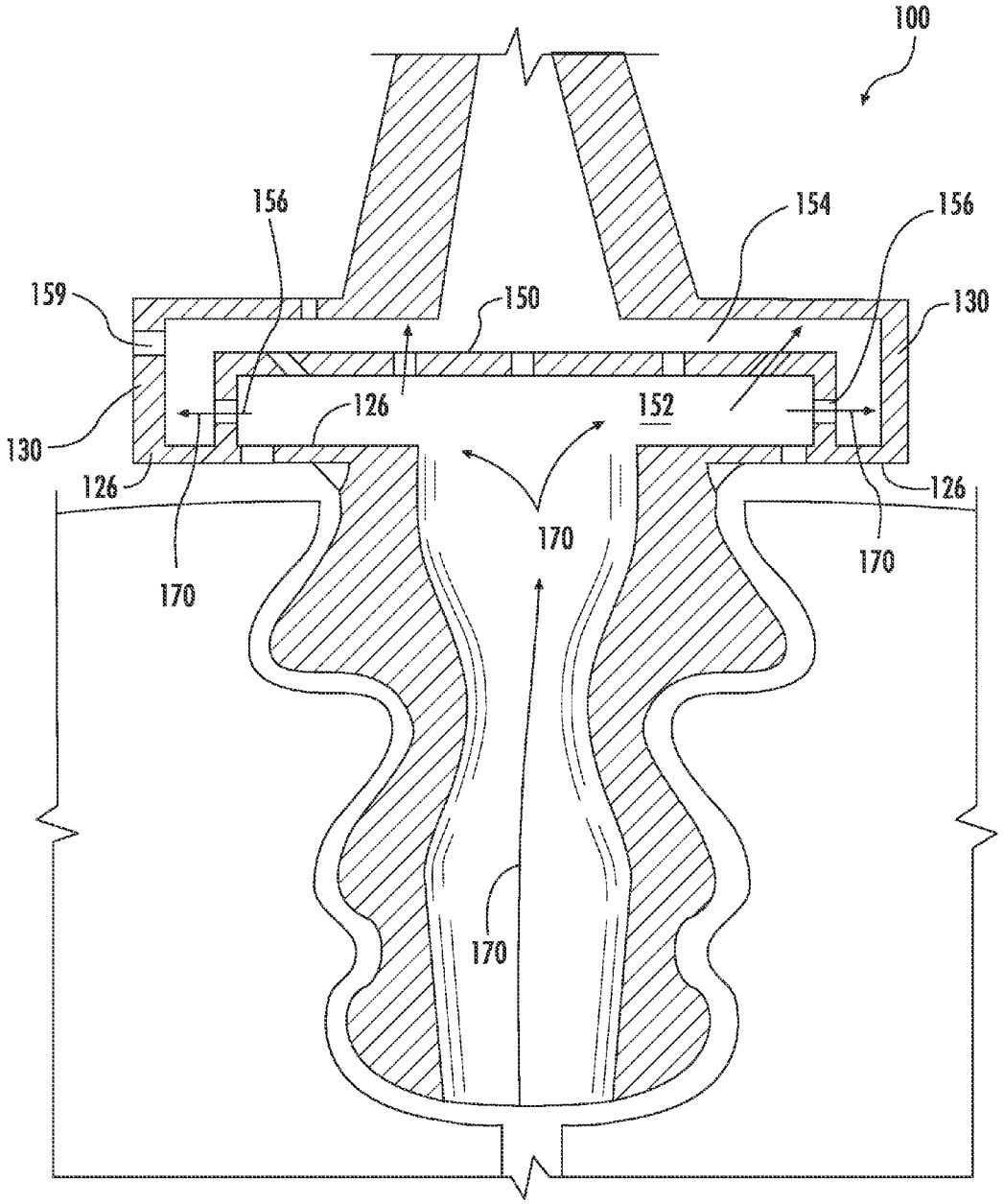
FIG. 11 provides a cross section front view of the turbine rotor blade as shown in FIG. 10 and a portion of a rotor disk, according to one embodiment of the present invention.

FIG. 10 provides a cross section side view of the turbine rotor blade as shown in FIG. 6, according to one embodiment of the present invention, and FIG. 11 provides a cross section front view of the turbine rotor blade as shown in FIG. 10 and a portion of a rotor disk, according to one embodiment of the present invention. As shown in FIG. 10, a baffle or wall 172 extends between the bottom wall 126 and the impingement plate 150. As shown in FIG. 10, the baffle 172 may extend between the bottom wall 126 and the impingement plate 150 proximate to either or both of the forward wall 122 and/or the aft wall 124. In addition or in the alternative, as shown in FIG. 11 the baffle may extend between the bottom wall 126 and the impingement plate 150 proximate to either or both of the side walls 130. As shown in FIGS. 10 and 11, the baffle 172 may at least partially define the first cooling chamber 152 and/or the second cooling chamber 154. One or more of the impingement holes 156 extend through the baffle 172 to direct an impingement jet of the cooling medium 170 onto one or more of the side walls 130 (FIG. 11), the forward wall (FIG. 10) and/or the aft wall (FIG. 10).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. A turbine rotor blade, comprising:

a mounting portion that partially defines a cooling circuit within the turbine rotor blade;

an airfoil portion that extends radially outward from the mounting portion, the airfoil portion further defining the cooling circuit;

a platform portion disposed radially between the mounting portion and the airfoil, the platform portion having a bottom wall, a top wall, a forward wall, an aft wall and a pair of opposing side walls;

a cooling plenum defined within the platform portion, the cooling plenum further defining the cooling circuit, wherein the cooling plenum is at least partially defined between the forward wall, the aft wall and between the pair of opposing side walls; and an exhaust outlet that extends through the bottom wall, wherein the exhaust outlet provides for fluid communication out of the cooling plenum.

2. The turbine rotor blade as in claim 1, further comprising a shank portion that extends between the mounting portion and the airfoil portion, the shank portion being at least partially encased within the cooling plenum.

3. The turbine rotor blade as in claim 1, further comprising an exhaust outlet that extends through one of the opposing side walls, wherein the exhaust outlet provides for fluid communication out of the cooling plenum.

4. The turbine rotor blade as in claim 1, wherein the top wall includes an inner side disposed within the cooling plenum, the turbine rotor blade further comprising an impingement plate that extends within the cooling plenum substantially parallel to the inner side, wherein the impingement plate defines a first cooling chamber and a second cooling chamber within the cooling plenum.

5. The turbine rotor blade as in claim 4, wherein the impingement plate includes a plurality of impingement cooling holes that provide for fluid communication between the first cooling chamber and the second cooling chamber.

6. The turbine rotor blade as in claim 4, further comprising one or more baffles that extend between the bottom wall and the impingement plate within the cooling plenum substantially proximate to at least one of the forward wall, the aft wall or the pair of opposing side walls.

7. The turbine rotor blade as in claim 6, further comprising one or more impingement cooling holes that extend through the baffle, wherein the impingement cooling holes are in fluid communication with the first cooling chamber.

8. A turbine section of a gas turbine, comprising:

a rotor shaft;

a rotor disk coupled to the rotor shaft, the rotor disk including a slot, the rotor disk defining a cooling flow outlet that extends through the slot;

a turbine rotor blade that extends radially outward from the rotor disk, the turbine rotor blade comprising:

a mounting portion disposed within the slot;

an airfoil portion that extends radially outward from the mounting portion;

a cooling circuit that extends between the mounting portion and the airfoil portion, wherein the cooling circuit is in fluid communication with the cooling flow outlet;

a platform portion disposed radially between the mounting portion and the airfoil portion, the platform portion having a bottom wall, a top wall, a forward wall, an aft wall and a pair of opposing side walls;

a cooling plenum defined within the platform portion, the cooling plenum further defining the cooling circuit, wherein the cooling plenum is at least partially defined between the forward wall, the aft wall and between the pair of opposing side walls within the platform portion; and an exhaust outlet that extends through the bottom wall, wherein the exhaust outlet provides for fluid communication out of the first cooling chamber towards the rotor disk.

9. The turbine section as in claim 8, further comprising one or more exhaust outlets that provide for fluid communication through one or more of the pair of opposing side walls, the top wall, the forward wall or the aft wall.

10. The turbine section as in claim 8, wherein the top wall includes an inner side disposed within the cooling plenum, the turbine rotor blade further comprising an impingement plate that extends within the cooling plenum substantially parallel to the inner side, wherein the impingement plate defines a first cooling chamber and a second cooling chamber within the cooling plenum.

11. The turbine section as in claim 10, wherein the impingement plate includes a plurality of impingement cooling holes that provide for fluid communication between the first cooling chamber and the second cooling chamber to impinge a flow of a cooling medium onto the inner side.

12. The turbine section as in claim 10, further comprising a baffle that extends between the bottom wall and the impingement plate within the cooling plenum substantially proximate to at least one of the forward wall, the aft wall or the pair of opposing side walls.

13. The turbine section as in claim 10, further comprising one or more impingement cooling holes that extend through the baffle, wherein the impingement cooling holes are in fluid communication with the first cooling chamber.

14. A turbine rotor blade, comprising:

a mounting portion that partially defines a cooling circuit within the turbine rotor blade;

an airfoil portion that extends radially outward from the mounting portion, the airfoil portion further defining the cooling circuit;

a platform portion disposed radially between the mounting portion and the airfoil, the platform portion having a bottom wall, a top wall, a forward wall, an aft wall and a pair of opposing side walls;

a cooling plenum defined within the platform portion, the cooling plenum further defining the cooling circuit, wherein the cooling plenum is at least partially defined between the forward wall, the aft wall and between the pair of opposing side walls, wherein the top wall includes an inner side disposed within the cooling plenum, the turbine rotor blade further comprising an impingement plate that extends within the cooling plenum substantially parallel to the inner side, wherein the impingement plate defines a first cooling chamber and a second cooling chamber within the cooling plenum, and wherein the impingement plate is disposed within both a pressure side portion and a suction side portion of the platform portion.

15. The turbine rotor blade as in claim 14, further comprising a shank portion that extends between the mounting portion and the airfoil portion, the shank portion being at least partially encased within the cooling plenum.

16. The turbine rotor blade as in claim 14, wherein the impingement plate includes a plurality of impingement cooling holes that provide for fluid communication between the first cooling chamber and the second cooling chamber.

17. The turbine rotor blade as in claim 14, further comprising one or more baffles that extend between the bottom wall and the impingement plate within the cooling plenum substantially proximate to at least one of the forward wall, the aft wall or the pair of opposing side walls.

18. The turbine rotor blade as in claim 17, further comprising one or more impingement cooling holes that extend through the baffle, wherein the impingement cooling holes are in fluid communication with the first cooling chamber.

* * * * *